US006722681B1

(12) United States Patent
Large

(10) Patent No.: US 6,722,681 B1
(45) Date of Patent: Apr. 20, 2004

(54) TRAY ASSEMBLY FOR WHEELCHAIRS

(76) Inventor: Richard L. Large, 9505 S. 27th, Lincoln, NE (US) 68512

( * ) Notice: Subject to any disclaimer, the term of this patent is extended or adjusted under 35 U.S.C. 154(b) by 0 days.

(21) Appl. No.: 10/359,946

(22) Filed: Feb. 6, 2003

Related U.S. Application Data

(60) Provisional application No. 60/365,855, filed on Mar. 19, 2002.

(51) Int. Cl.[7] ..... A47B 83/02

(52) U.S. Cl. ..... 280/304.1; 297/150; 297/155

(58) Field of Search ..... 280/250.1, 304.1; 297/DIG. 4, 148, 149, 150, 160, 161, 162, 171, 173, 174, 155

(56) References Cited

U.S. PATENT DOCUMENTS 3,575,466 A * 4/1971 Thomas et al. ..... 297/155
3,860,285 A * 1/1975 Hartman ..... 297/150
3,870,362 A 3/1975 Large ..... 297/155
4,428,616 A * 1/1984 Hamilton ..... 297/145
4,779,884 A * 10/1988 Minati ..... 280/304.1
5,139,309 A * 8/1992 Kornreich ..... 297/162
5,228,711 A * 7/1993 Summers ..... 280/304.1
5,567,080 A * 10/1996 Sterlacci ..... 403/322.1
5,842,745 A * 12/1998 Kelly et al. ..... 297/153

* cited by examiner

*Primary Examiner*—Anne Marie Boehler
(74) *Attorney, Agent, or Firm*—Suiter West PC LLO

(57) ABSTRACT

A tray assembly which provides a tray and may be attached to most chair assemblies, such as a wheelchair, stationary chair, or the like, is disclosed. The tray assembly is constructed so that the tray is movable between a utilization position and a storage position while still allowing an occupant of the chair assembly to use the chair assembly in its fullest capacity. A first arm of the tray is connected by a swivel assembly to an extension member. The extension member is coupled with a mounting tube, the extension member may rotate and slide in a telescopic fashion relative to the mounting tube and be removed from the mounting tube. The mounting tube includes a ball knob assembly and is coupled to a support arm of the chair assembly. A second arm of the tray includes a multiple connection assembly which couples with a fastener assembly to affix the tray in the utilization position and couples with the ball knob assembly to affix the tray in the storage position.

20 Claims, 12 Drawing Sheets

TRAY ASSEMBLY FOR WHEELCHAIRS

CROSS REFERENCE TO RELATED APPLICATION

The present application claims priority under 35 U.S.C. §119(e) to U.S. Provisional Application No. 60/365,855 filed Mar. 19, 2002, which is herein incorporated by reference in its entirety.

FIELD OF THE INVENTION

The present invention generally relates to the field of wheelchairs and particularly to a tray assembly attachable to a wheelchair for providing a tray which may be used and stored on the wheelchair while allowing a user of the wheelchair to maintain operation of the wheelchair.

BACKGROUND OF THE INVENTION

U.S. Pat. No. 3,870,362 granted to Applicant on Mar. 11, 1975 describes a tray for attachment to a wheelchair. The tray attachment described in U.S. Pat. No. 3,870,362 was limited in its use and exceptionally expensive to fabricate. Consequently, use of the tray design was impractical. However, the need for a readily accessible and storable wheelchair tray is still as apparent now as it appeared to be when U.S. Pat. No. 3,870,362 was granted in 1975. The present commercial outlets of wheelchair trays typically provide trays held in place by Velcro, which must be removed for the occupant to enter or leave the wheelchair. Also available are partial width trays hinged to the arm of the wheelchair. Such trays which must be removed are temporarily stored, and thus may be inconveniently next needed. Moreover, the tray disclosed by U.S. Pat. No. 3,870,362 contained features which required extensive machining during manufacture, was time consuming to assemble, and was somewhat difficult to install on a wheelchair.

Consequently, it would be desirable to simplify the tray attachment to reduce the cost of parts and assembly, and to minimize the difficulty of installation to the wheelchair. Further, it is desirable to make the location of the tray more easily adjusted with respect to the castered front wheel; to make the height at which the forward portion of the tray may be stored adjustable by a user of the wheelchair; to make the mounting versatile so the tray attachment can be used with wheelchairs with shortened arm rests; to more easily allow the occupant to move the tray from the use position to the stored position and the reverse by using only one arm; and to allow the occupant or caregiver to use the tray assembly to provide stability to and for the occupant by limiting the movement of the tray in the use position.

SUMMARY OF THE INVENTION

Accordingly, the present invention is directed to a novel tray assembly attachable to a chair assembly, such as a wheelchair, stationary chair, or the like. The tray assembly includes a tray and may be mounted on most chair assemblies having an essentially full length normal horizontal support arm, which may include an arm rest. The tray assembly may also be mounted on shortened horizontal support desk arm wheelchairs which allowed the chair assembly and its occupant to get closer to a table. The construction and installation of the tray assembly allows the tray to be stored at the side of the chair assembly. For example, when connected to a wheelchair the tray assembly is outside the large diameter rear wheel in a manner which allows the maximum exposure of the drive wheel rim. The construction of the tray assembly allows the occupant to grasp, pull and lift the tray upward and around into the utilization position. The mechanisms that allow that to occur are an extension member sliding and rotating within a mounting tube and a swivel assembly connecting the tray to the extension member. The tray assembly is so designed that the parts used to support the tray in the storage position are also used to assist in restraining the occupant in the utilization position.

The tray assembly of the present invention also allows the occupant more independence by having the tray attached to the chair assembly in such a manner as to seem an integral part of the chair assembly. The tray assembly provides for easy removal from a chair assembly by pulling the extension tube out of the mounting tube. The tray assembly also reduces the cost of parts and assembly and minimizes the difficulty of installation to the chair assembly. Further, when the tray assembly is mounted to a wheelchair the location of the tray allows the tray to be more easily adjusted with respect to the castered front wheel. Additionally, the height at which the forward portion of the tray may be stored is adjustable by a user of the wheelchair, and the mounting is made versatile so the tray assembly may be used with wheelchairs with shortened armrests. The present invention allows the occupant to move the tray from the use position to the stored position and the reverse by using only one arm, and allows the occupant or caregiver to use the tray assembly to provide stability to and for the occupant by limiting the movement of the tray in the use position. The present invention also simplifies the use of the tray to allow the partially disabled to more easily move the tray from the stored position to the utilization position and return it to the stored position.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

Features, improvements and advantages of the present invention will become more apparent from the following detailed description, appended claims and the accompanying drawings in which:

DETAILED DESCRIPTION OF THE INVENTION

Figure 1:
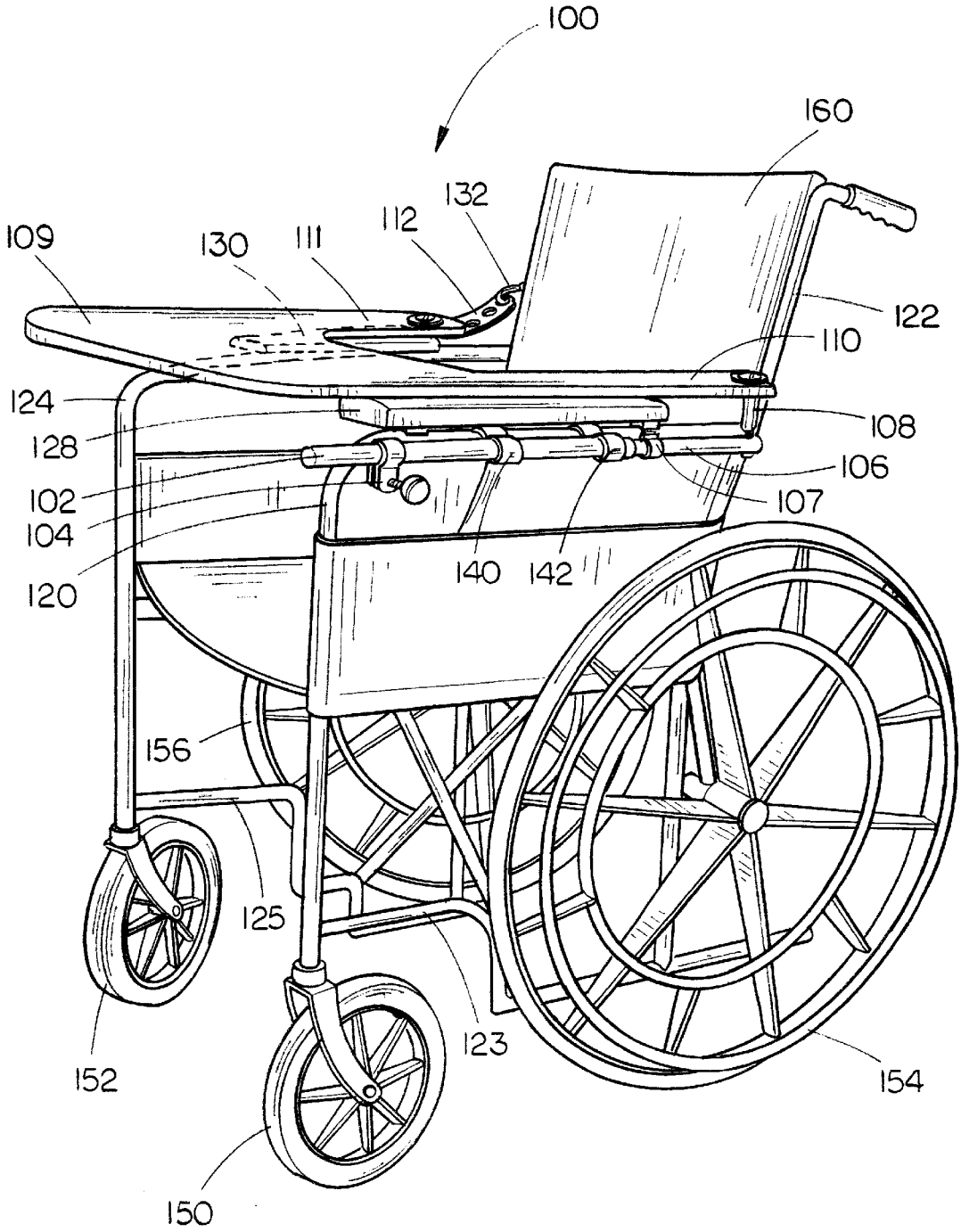
FIG. 1 is an isometric view illustrating a tray assembly of the present invention with a tray in a utilization position in accordance with an exemplary embodiment of the present invention.

Reference will now be made in detail to the presently preferred embodiments of the invention, examples of which are illustrated in the accompanying drawings.

Referring generally now to FIGS. 1 through 8, a chair assembly 100 comprises a wheelchair coupled with a tray assembly in accordance with an exemplary embodiment of the present invention. Preferably, the chair assembly 100 includes a first support arm 120 connected to a first rear vertical support member 122 and a second support arm 124 connected to a second rear vertical support member 126. A first lower cross support 123 couples with the first support arm 120 and the first rear vertical support member 122. A second lower cross support 125 couples with the second support arm 124 and the second rear vertical support member 126.

Coupled with the first support arm 120 is an arm rest 128 and a first castered wheel 150, coupled with the second support arm 124 is an arm rest 130 and a second castered wheel 152. Coupled to the first rear vertical support member 122 is a first large diameter drive wheel 154 and coupled to the second rear vertical support member 126 is a second large diameter drive wheel 156. A seat 160 is coupled to both rear vertical support members 122 and 126, and both support arms 120 and 124. It is contemplated that seat 160 may be a collapsible seat allowing the chair assembly 100 to collapse and reduce the size of the chair assembly 100 during storage. While the chair assembly 100 discloses a wheelchair, it is understood that the chair assembly 100 may include a variety of chairs, such as stationary chairs, mobile chairs, and the like.

In the current embodiment, a mounting tube 102 is coupled to the first support arm 120. It is understood that the mounting tube 102 may be mounted to the second support arm 124. The coupling of the mounting tube 102 to the first support arm 120 is through the use of a first mounting assembly 140 and a second mounting assembly 142. The diameter of the mounting tube 102 being substantially identical to the diameter provided for by the first and second mounting assemblies 140 and 142. It is understood that a variety of clamping mechanisms may be employed to affix the mounting tube 102 to the first support arm 120 without departing from the scope and spirit of the present invention.

The mounting tube 102 includes a ball knob assembly 104 disposed upon one end. The mounting tube 102 is a hollow open ended tube and allows an extension member 106 to be telescopically and rotatably disposed within the mounting tube 102. In a preferred embodiment, the mounting tube 102 is of such a length as to be substantially even with the forward edges of the first and second support arms 120 and 124. In an alternative embodiment, the mounting tube 102 may be of a length substantially equal to twelve inches while the extension tube 106 may be twenty four inches in length. The extension member 106 inserts within one end of the mounting tube 102 and extends out the other end. It is contemplated that the length of the mounting tube 102 may vary as well as the configuration of the ends of the mounting tube 102. For example, the mounting tube may be twenty four inches in length and have one closed end so that the extension member 106 does not extend out of the mounting tube 102. Further, the diameter of the mounting tube 102 may vary to accommodate differently sized mounting assemblies.

The extension member 106 includes a swivel assembly 108, which connects with a first arm 110 of a tray 109. The extension member 106 further includes a stop assembly 107 which limits the range of movement of the extension member 106 relative to the mounting tube 102. The stop assembly 107 may be movable upon the extension member 106 and limits movement by coming into contact with the end of the mounting tube 102. In an alternative embodiment, the stop assembly 107 may be a variety of devices, such as a clamp and the like. A variety of systems may be contemplated by one of ordinary skill in the art and employed to provide range of motion limitations, without departing from the scope and spirit of the present invention.

The extension member 106 may be removed form the mounting tube 102. The extension member 106 may slide out of the mounting tube 102 completely. Thus, the tray 109 may be removed from the chair assembly 100. This enables easier storage of the chair assembly 100. For example, a user of the chair assembly 100 may need to load it into a car with limited available space. With the tray 109 attached to the chair assembly 100 it may not be possible to fit the chair assembly 100 into the available space. By providing the ability to remove the tray 109 from the chair assembly 100 the user may accomplish placing the chair assembly 100 into the car. The mounting tube 102 may remain mounted to the chair assembly 100 to facilitate re-attachment of the tray 109 to the chair assembly 100.

In an alternative embodiment of the chair assembly 100, the extension member 106 may further include a ball knob assembly. In such an embodiment, the extension member 106 is disposed with the swivel assembly 108 on a first end and on a second end of the extension member 106 the ball knob assembly is mounted. The swivel assembly 108 is connected to the tray 109 in a similar manner as that shown and described previously. The ball knob assembly limits the range of telescopic movement of the extension member 106 within the mounting tube 102 and provides support to the tray 109 when in the utilization position. Further, the ball knob assembly is enabled to rotate into a position which enables the ball knob assembly to be used for storage of the tray 109 upon the chair assembly. The stop assembly 107 may be included on the opposite side of the mounting tube from the ball knob assembly to further limit telescopic range of motion of the extension member. A removal system may be coupled with the ball knob assembly to allow a user to remove the ball knob assembly from the extension member 106. This enables the user to remove the extension member 106 from the mounting tube 102, thus, the user may remove the tray 109 from the chair assembly 100.

The tray 109 includes the first arm 110 and a second arm 111. The first and second arms 110 and 111 provide a recess in the tray 109 which may accommodate a user more easily when the tray 109 is in the utilization position, as shown in FIG. 1. While in the utilization position the tray 109 is supported by the first arm rest 128 and the second arm rest 130. Thus, no further manufacturing of parts or added installation costs are forced upon a user of the tray assembly, the existing parts of the wheelchair are used to provide a working tray. Coupled with the second arm 111 is a multiple connection assembly 112. The multiple connection assembly 112 allows the second arm 111 to couple with a fastener assembly 132 disposed on the second rear vertical support member 126. In this manner the tray 109, when in the utilization position, is held in place.

Figure 2:
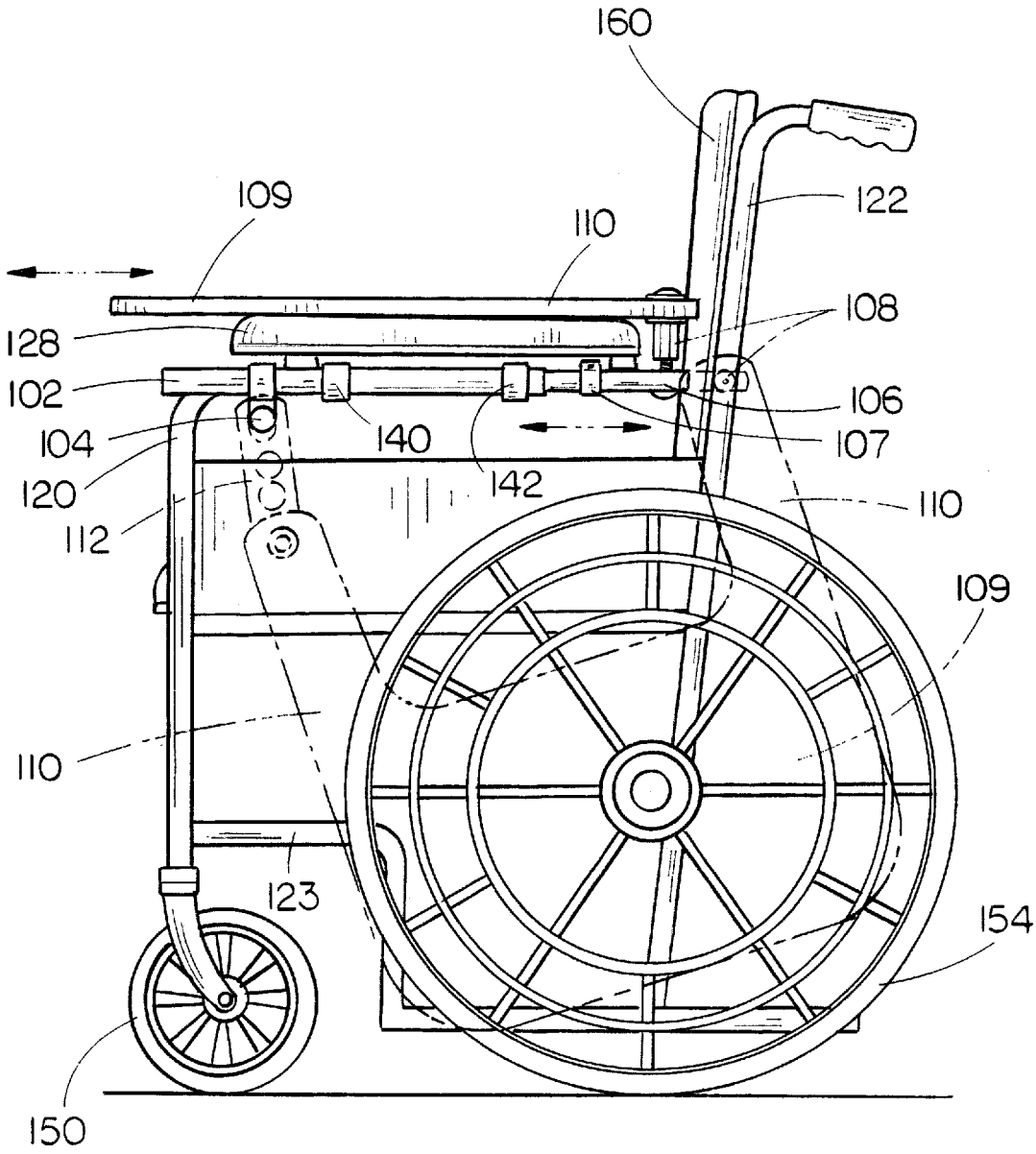
FIG. 2 is a side elevation view illustrating the tray assembly in a storage position in accordance with an exemplary embodiment of the present invention.

The tray 109 is shown in the storage position in FIG. 2. The extension member 106 slides back and provides the ability to rotate the tray 109 down towards the first large diameter drive wheel 154. The swivel assembly 108 allows the tray 109 to rotate to a position substantially parallel to the first large diameter drive wheel 154 when in the storage position. The distance provided by the swivel assembly 108 between the extension member 106 and the tray 109 is sufficient to allow the tray 109 to store appropriately along side the first large diameter drive wheel 154. Further, a wheel chair that includes a propelling ring coupled to the large diameter drive wheels may be accommodated allowing the user access to the propelling ring for control of the wheelchair. The multiple connection assembly 112 engages with the ball knob assembly 104 to secure the position of the tray 109 in the storage position, thereby preventing the tray 109 from moving. The engagement of the multiple connection assembly 112 with the ball knob assembly 104 limits movement of the extension member 106 within the mounting tube 102. This prevents the extension member 106 from sliding out of the mounting tube 102 while the tray 109 is in the storage position. Thus, inadvertent or unintentional removal of the extension member 106 and the tray 109 is avoided. The recess of tray 109 is another feature which allows a user of the chair assembly 100 access to the first large diameter drive wheel 154, and/or a propelling ring, while the tray 109 is in the storage position. This is advantageous because a wheelchair user is no longer required to remove and store the tray separately. Thus, a user of the chair assembly 100 may have access to a tray 109 at all times while still maintaining the ability to easily enter and exit, as well as utilize, the chair assembly 100.

In an alternative embodiment the tray assembly may be enabled with a motion assembly which allows a user to move the tray 109 to and from the storage and utilization positions. The motion assembly may include a hydraulic mechanism, mechanical mechanism, or the like. The tray assembly may include an arm connected to the underside of the tray 109 which is in turn enabled to move the tray into either the storage or the utilization positions. It is contemplated that other methods of enabling the tray assembly for assisting the placement of the tray in the storage or utilization positions as may be contemplated by one of ordinary skill in the art may be included without departing from the scope and spirit of the present invention.

Figure 3:
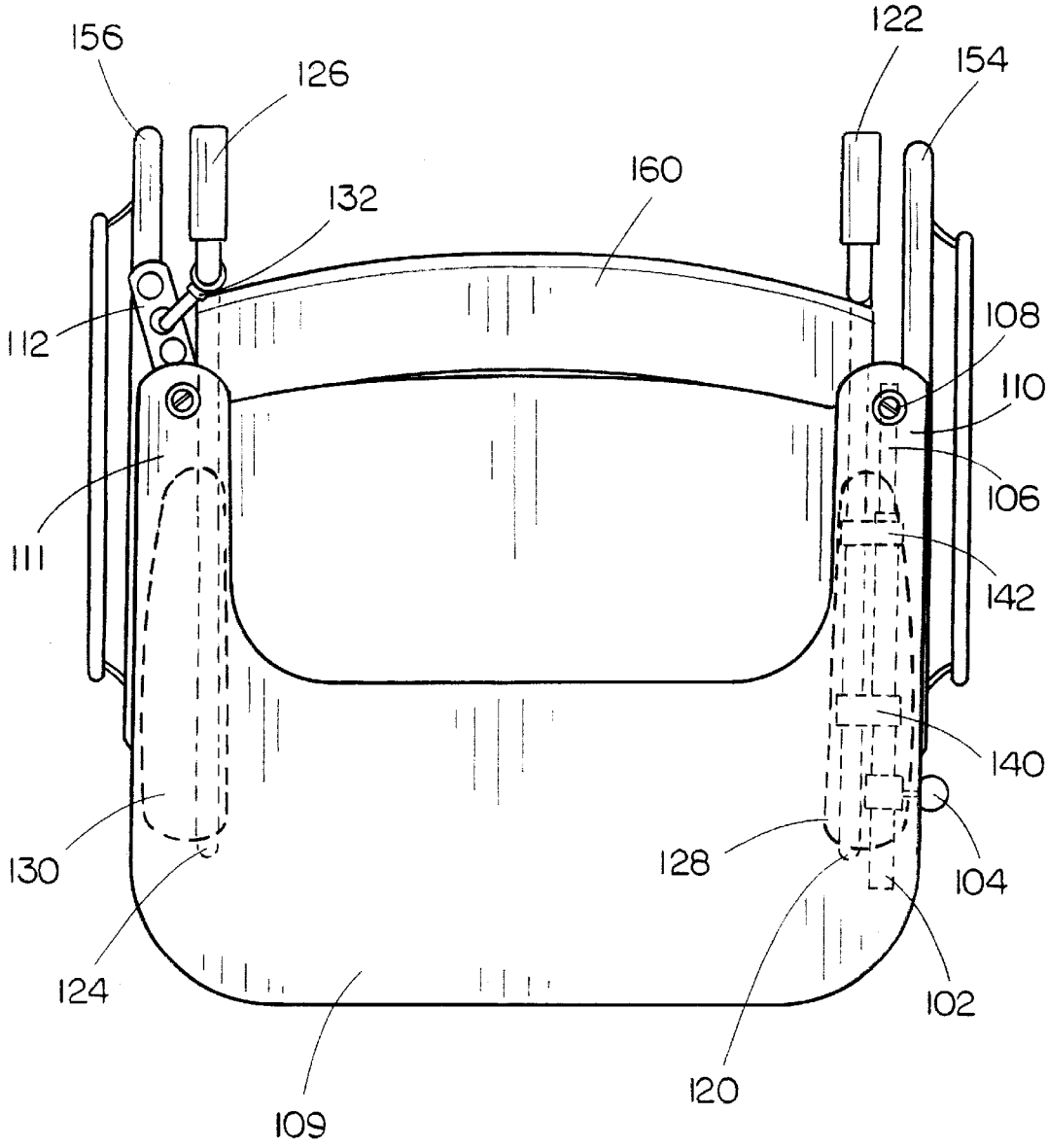
FIG. 3 is a top plan view illustrating the tray assembly in the utilization position.

The top plan view of FIG. 3 shows the chair assembly 100 with the tray 109 being supported upon the first arm rest 128 and the second arm rest 130. The recess provided by the first arm 110 and the second arm 111 of the tray 109 is also shown. The multiple connection assembly 112 allows the user of seat 160 to adjust the position of the tray 109, enlarging or decreasing the size of the recess, through attachment with the fastener assembly 132. As shown, the fastener assembly 132 is attached to the second loop of the multiple connection assembly 112. Alternatively, the fastener assembly 132 may be attached to any of the three loops available on the multiple connection assembly 112. It is understood that the number of loops available on the multiple connection assembly 112 may vary as contemplated by one of ordinary skill in the art. Adjustment of the size of the recess provided by tray 109 is also facilitated by the mounting tube 102 allowing the extension member 106 to be telescopically maneuvered to accommodate a variety of positions for the tray 109 when in the utilization position.

Figure 4:
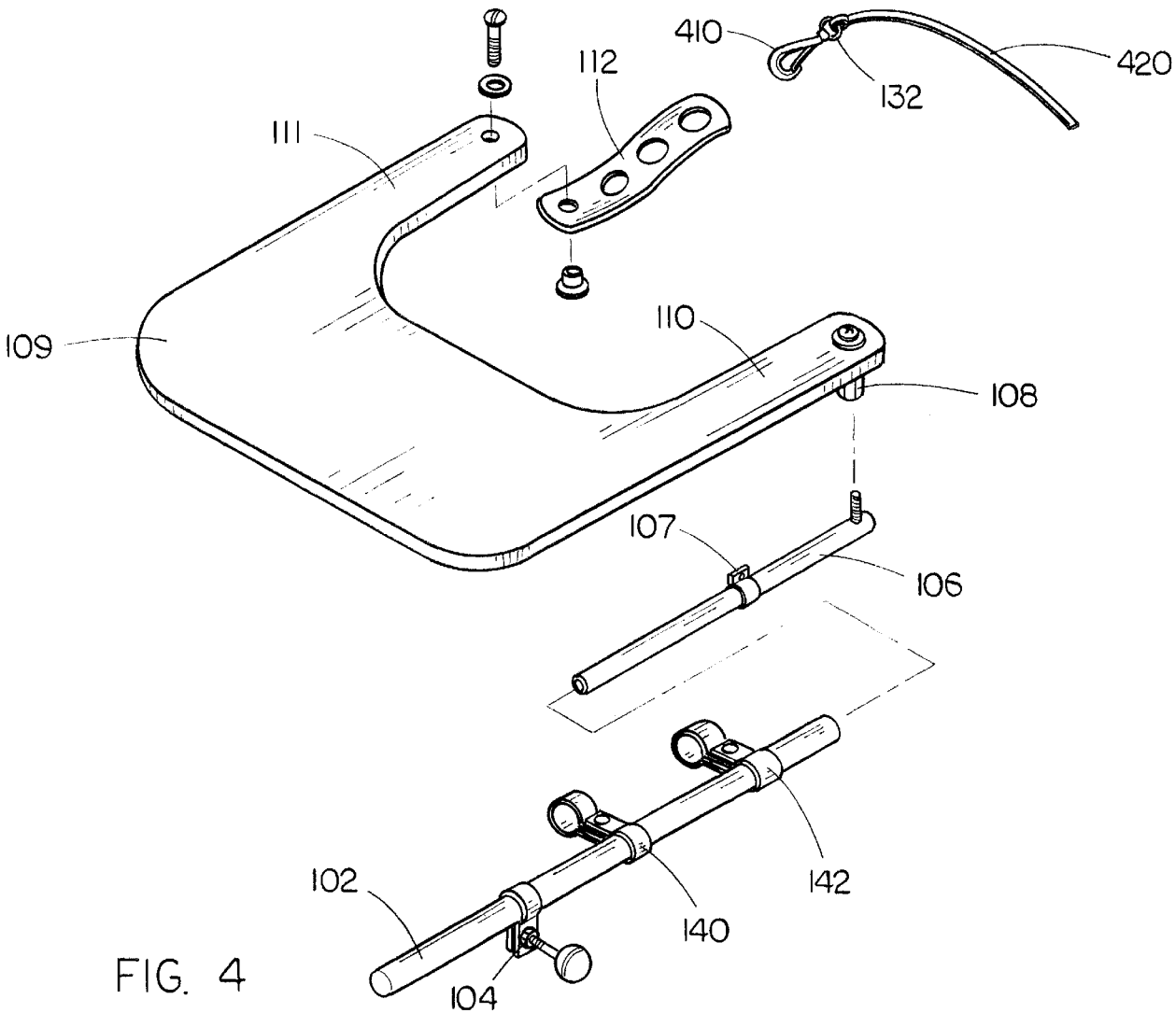
FIG. 4 is an exploded view of the tray assembly.

An exploded view of a tray assembly 400 is shown in FIG. 4 including the fastener assembly 132. Preferably, the fastener assembly 132 includes a snap 410 affixed with a strap 420. The snap 410 may be a variety of devices, such as a buckle, compression lock, ball knob, or the like. The strap 420 couples with the second rear vertical support member 126 of the chair assembly 100. The strap 420 may be adjustably coupled to the second rear vertical support member 126, allowing the strap 420 to move along the second rear vertical support member 126. A user may position the strap 420 in a variety of locations to accommodate individual needs. It is understood that use of the strap 420 to affix the snap 410 to the chair assembly 100 is exemplary and that other methods and means of affixing the snap 410 to the chair assembly 100 may be employed without departing from the scope and spirit of the present invention. For example., the strap 420 may be a compression lock, magnetic attachment, buckle, or the like, and further the strap 420 may provide an adjustable positioning means for the snap 410.

Figure 5:
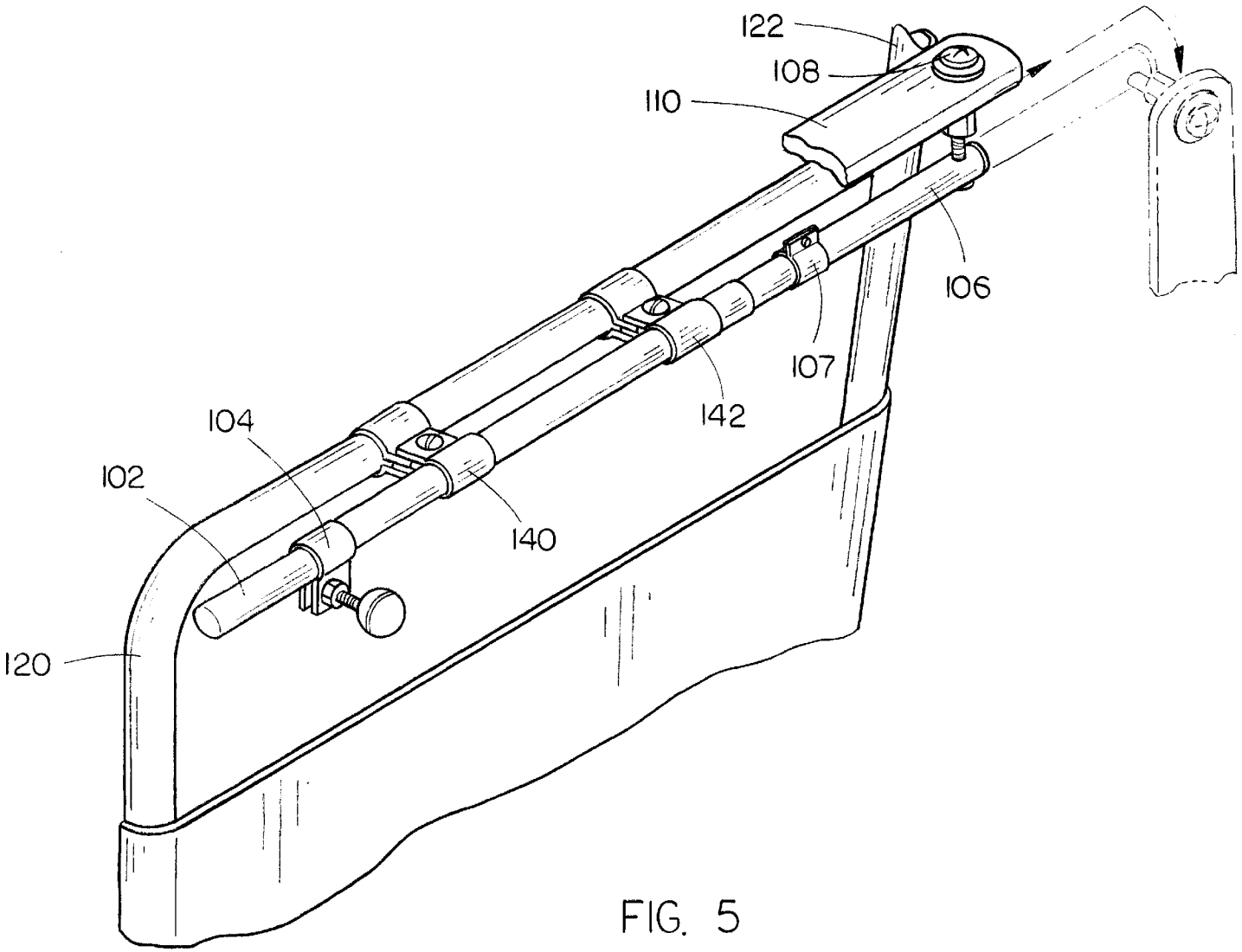
FIG. 5 is an illustration of a first arm of the tray coupled to an extension member, which is disposed within a mounting tube coupled to a wheelchair in accordance with an exemplary embodiment of the present invention.

With the arm rest 128 removed, the mounting tube 102 is shown connected to the first support arm 120 in FIG. 5. The telescopic and rotational movement capabilities of the extension member 106 within the mounting tube 102 are also illustrated. Further, the swivel assembly 108 is shown coupled with the first arm 110 of the tray 109. The rotational movement of the tray 109 when placed into the storage position is enabled by the swivel assembly 108 which allows the first arm 110 of the tray 109 to pivot freely. The stop assembly 107 limits the range of forward movement of the extension member 106, which limits the forward movement of the tray 109. The stop assembly 107 may be positioned by the user at any point between the swivel assembly 108 and the open end of the hollow mounting tube 102 within which the extension member 106 inserts. In this manner the user may further determine the size of the occupant recess made available by the tray 109 when in the utilization position.

Figure 6:
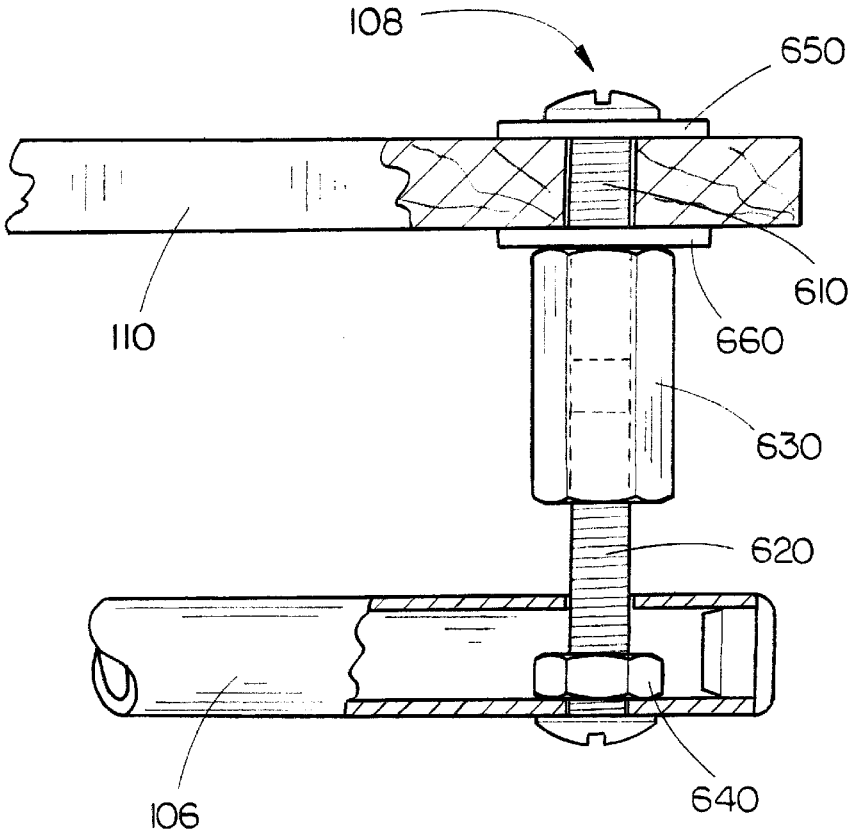
FIG. 6 is an illustration of a swivel assembly that couples the tray to the extension member.

An illustration of the swivel assembly 108 is shown in FIG. 6. The swivel assembly 108 comprises a first bolt 610 and a second bolt 620. The first bolt 610 is inserted through the first arm 110 of the tray 109 and is cushioned with a first fender washer 650 and a second fender washer 660 and tightened to a coupler 630. It is understood that the first and second bolts 610 and 620 may be a variety of fasteners, such as a socket head screw, or the like. The second bolt 620 is captured through the wall of the extension member 106 by the insertion of a nut 640 through and into the extension member 106. The second bolt 620 is threaded through the nut 640 until the nut 640 tightly bottoms out against the inside wall of the extension member 106. The first bolt 610 and the second bolt 620 are threaded into the coupler 630. The coupler 630 allows the tray to rotate with the extension member 106 and swivel into its utilization or storage positions.

It is further contemplated that the swivel assembly 108, through use of the coupler 630, may be enabled to provide height adjustment capabilities to the tray assembly, allowing a user to adjust the height of the tray 109 relative to the position of the user in the seat 160. Preferably, height adjustments may be made with the extension member 106 removed from the mounting tube 102. However, it is contemplated that height adjustments may be made while the extension member 106 is engaged within the mounting tube 102.

Figure 7:
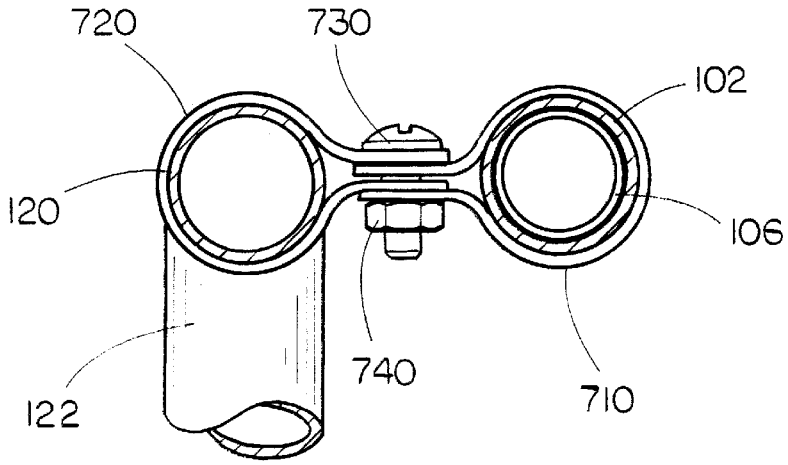
FIG. 7 is an illustration of a mounting assembly that couples the mounting tube of the tray assembly to the wheelchair.

An exemplary embodiment of the first and second mounting assemblies 140 and 142, which attach the mounting tube 102 to the first support arm 120, is shown in FIG. 7. The mounting assemblies 140 and 142 include a first clamp 710 and a second clamp 720. The clamps are interlocked by use of a single bolt 730 and nut 740. The first clamp 710 engages the mounting tube 102 which is internally disposed with the extension member 106. The second clamp 720 engages the first support arm 120. When tightened, bolt 730 and nut 740 anchor the mounting tube 102 to the first arm support 120. Further, by loosening the bolt 730 and nut 740 a user may slidably position the mounting assemblies 140 and 142 relative to the first support arm 120 or allow the mounting tube 102 to be repositioned within the clamps. The distance between the centerlines of the first support arm 120 and the mounting tube 102 provided by the first and second mounting assemblies 140 and 142 is of such a distance that the addition of the distance provided by the swivel assembly 108 allows the tray to be stored appropriately along side the first large diameter drive wheel 154.

Figure 8:
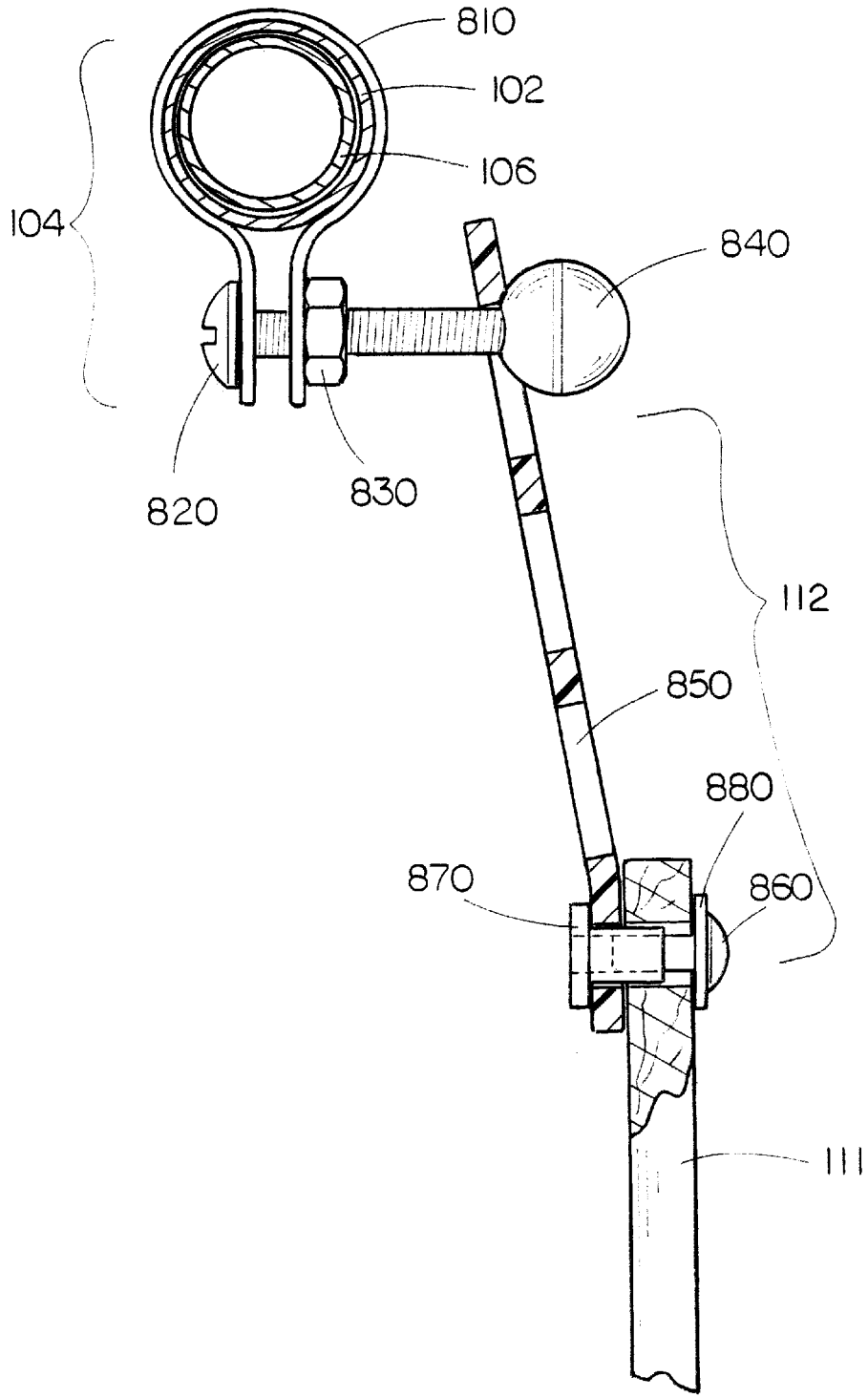
FIG. 8 is an illustration of a ball knob assembly coupling with a multiple connection assembly when the tray assembly is in the storage position.

FIG. 8 provides an illustration of the multiple connection assembly 112 coupled with the ball knob assembly 104. Preferably, the ball knob assembly 104 includes a clamp 810 which encompasses mounting tube 102. It is understood that the clamp 810 may be positioned along the mounting tube 102 to adjust the stored position of the tray 109 with respect to the first castered wheel 150. A bolt 820 is threaded through an end of the clamp 810 and locks the position of the clamp 810 in place by use of a nut 830. In addition a ball knob 840 is connected to the bolt 820.

The multiple connection assembly 112 includes an extendor 850 which is connected to the second arm 111 of the tray 109 by a socket head screw 860, a fender washer 880, and a threaded T-nut 870. The exposed surface of the T-nut 850 is substantially flat and smooth, allowing the T-nut to be used with fabric covered surfaces of the arm rests 128 and 130. In the current embodiment, the extendor 850 is a flexible strap disposed with three coupling positions. It is contemplated that the number of coupling positions disposed on the extendor 850 may vary as contemplated by one of ordinary skill in the art. Preferably, the coupling positions comprise holes in the extendor 850 which are larger than the diameter of the ball knob 840 so that the ball knob 840 may be inserted through the holes and maintain the position of the tray 109 while in the storage position. The extendor 850 may be comprised of a variety of materials, such as leather, plastic, or the like. The three coupling positions may be established through use of a variety of mechanisms, such as snaps, buttons, buckles, or the like.

It is contemplated that the tray assembly of the present invention is reversible, capable of being mounted on either side of the chair assembly 100. The mounting assemblies 140 and 142 may be coupled to the second arm 124 of the chair assembly 100. The mounting tube 102 may be affixed in place by the mounting assemblies 140 and 142 to the second arm 124 of the chair assembly 100. The swivel assembly 108, coupled to the extension member 106, may be removed from the first arm 110 of tray 109 and disposed in the second arm 111 of the tray 109. Additionally, the multiple connection assembly 112 may be removed from the second arm 111 of the tray 109 and disposed in the first arm 110 of the tray 109. The fastener assembly 132 may be removed from the second rear vertical support member 126 and affixed to the first rear vertical support member 122 in order to fasten with the multiple connection assembly 112 when the tray assembly is in the utilization position.

Referring generally now to FIGS. 9 through 13, a chair assembly 900, substantially similar to the chair assembly 100 shown and described in FIGS. 1 through 8, comprises a wheelchair coupled with a tray assembly in accordance with an exemplary embodiment of the present invention. Preferably, the chair assembly 900 includes a first support arm 920 connected to a first rear vertical support member 922 and a second support arm 924 connected to a second rear vertical support member 926. A first lower cross support 923 couples with the first support arm 920 and the first rear vertical support member 922. A second lower cross support 925 couples with the second support arm 924 and the second rear vertical support member 926. Coupled with the first support arm 920 is a first forward seat support member 948 which is further coupled with a first castered wheel 950. Coupled with the second support arm 924 is a second forward seat support member 949 which is further coupled with a second castered wheel 952. Coupled to the first rear vertical support member 922 is a first large diameter drive wheel 954 and coupled to the second rear vertical support member 926 is a second large diameter drive wheel 956. A seat 960 is coupled to both rear vertical support members 922 and 926, and both support arms 920 and 924. It is contemplated that seat 960 may be a collapsible seat allowing the chair assembly 900 to collapse and reduce the size of the chair assembly 900 during storage.

In the current embodiment, the first and second support arms 920 and 924 are shortened and do not extend to the end of the seat 960 as is shown in chair assembly 100. The first and second forward seat support members 948 and 949 extend to provide horizontal and vertical support to the chair assembly 900 including the seat 960. Further, the first or second support arms 920 and 924 are coupled with an armrest as they are in chair assembly 100.

Figure 10:
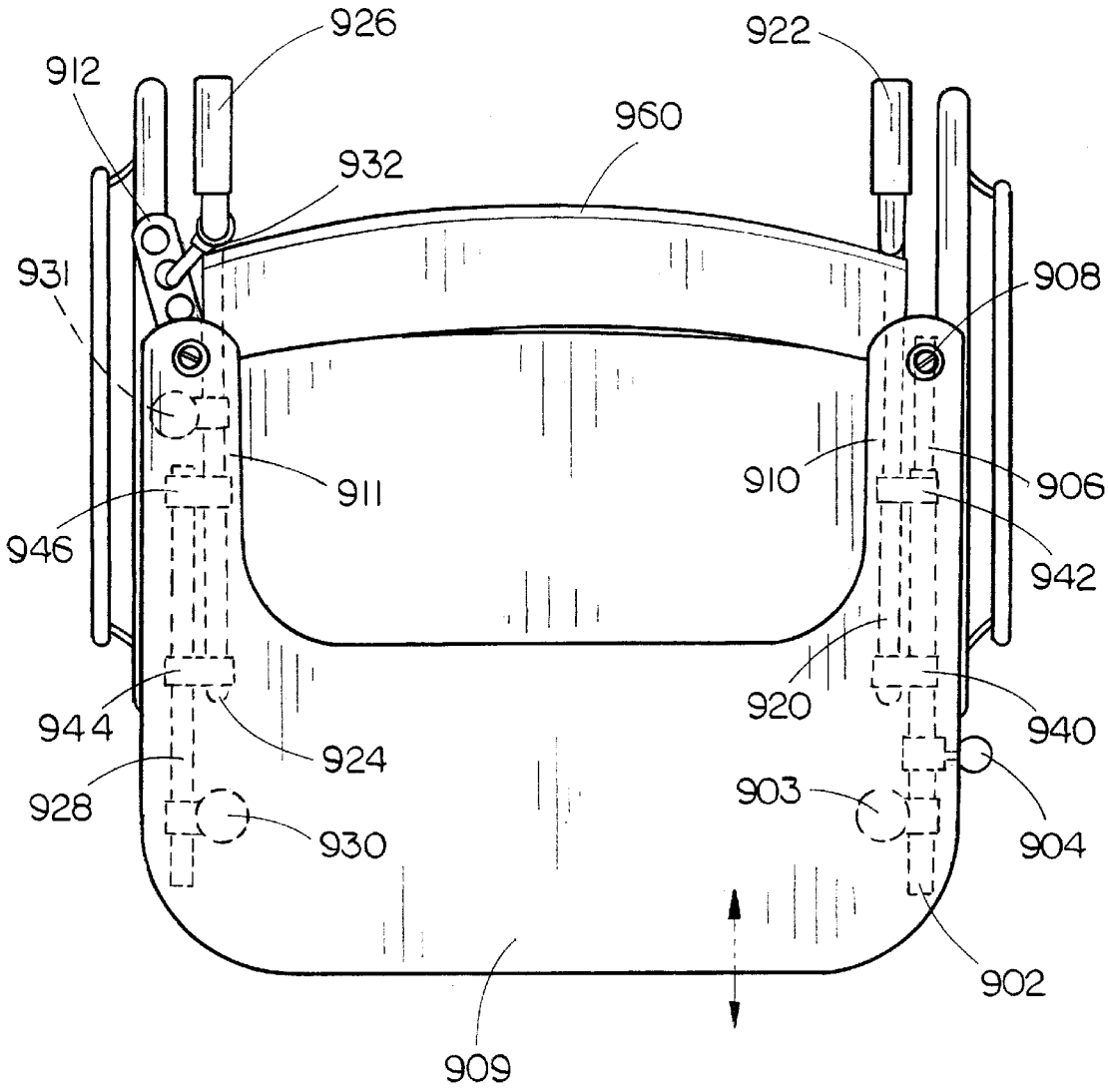
FIG. 10 is a top plan view illustrating the tray assembly of FIG. 9 in the utilization position.

Preferably, a first mounting tube 902 is coupled to the first support arm 920 and a second mounting tube 928 is coupled to the second support arm 924. The coupling of the first and second mounting tubes 902 and 928 to the first and second support arms 920 and 924 is through the use of a first mounting assembly 940, a second mounting assembly 942, a third mounting assembly 944 and a fourth mounting assembly 946, as shown in FIG. 10. The first mounting tube 902 includes a first ball knob assembly 904 and a second ball knob assembly 903. The second mounting tube 928 includes a third ball knob assembly 930 and a fourth ball knob assembly 931. The mounting tube 902 is hollow and allows an extension member 906 to be telescopically and rotatably disposed within the mounting tube 902. The second mounting tube 928 is a solid tube and does not have a separate extension member disposed within it. It is contemplated that second mounting tube 928 may be configured like the first mounting tube 902 as a hollow tube enabling coupling with an extension member or be given a variety of alternative configurations as may be contemplated by one of ordinary skill in the art.

The extension member 906 inserts into and extends through the first mounting tube 902. The extension member 906 includes a swivel assembly 908, which connects with a first arm 910 of a tray 909. The extension member 906 further includes a stop assembly 907 which limits the range of movement of the extension member 906 relative to the first mounting tube 902. In an alternative embodiment (not shown), it is contemplated that the extension member 906 may include a ball knob assembly disposed on the end opposite the swivel assembly 908. The ball knob assembly provides support to the tray 909 when in the utilization position. Since such a ball knob assembly would be enabled to rotate along with the extension member 906, it may be used to store the tray by allowing attachment of a multiple connection assembly 912 (described below). Further, such a ball knob assembly may include a removal system to maintain the ability of a user of the chair assembly 900 to remove the tray for storage purposes.

Figure 9:
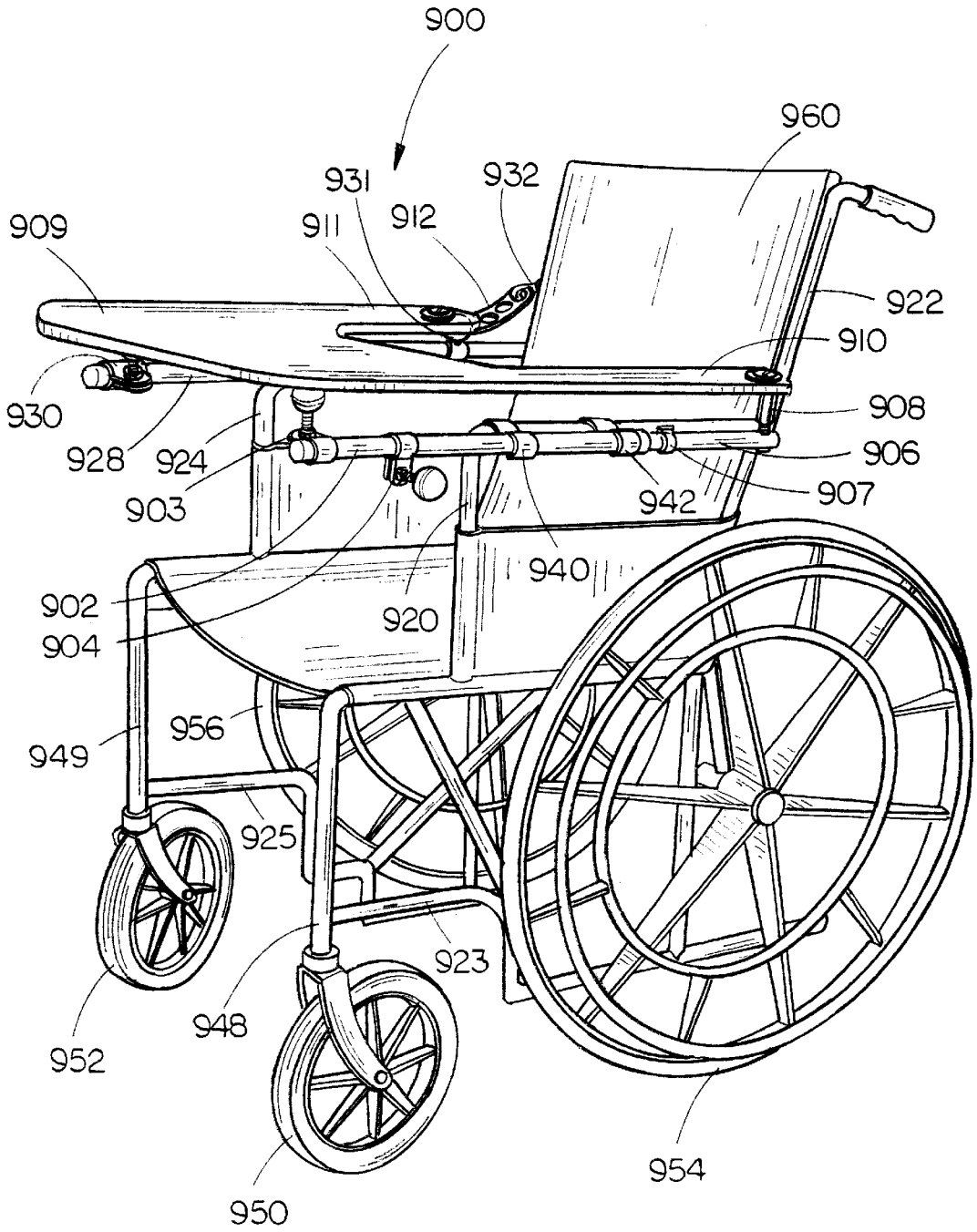
FIG. 9 is an isometric view illustrating a tray assembly of the present invention coupled to a desk arm type wheel chair with a tray in a utilization position in accordance with an exemplary embodiment of the present invention.

The tray 909 includes the first arm 910 and a second arm 911. The first and second arms 910 and 911 provide a recess in the tray 909 which may accommodate a user more easily when the tray 909 is in the utilization position, as shown in FIGS. 9 and 10. While in the utilization position the tray 909 is supported by the second ball knob assembly 903, the third ball knob assembly 930 and the fourth ball knob assembly 931, as discussed below. Coupled with the second arm 911 is the multiple connection assembly 912. The multiple connection assembly 912 allows the second arm 911 to couple with a fastener assembly 932 disposed on the second rear vertical support member 926. In this manner the tray 909, when in the utilization position, is held in place.

Figure 13:
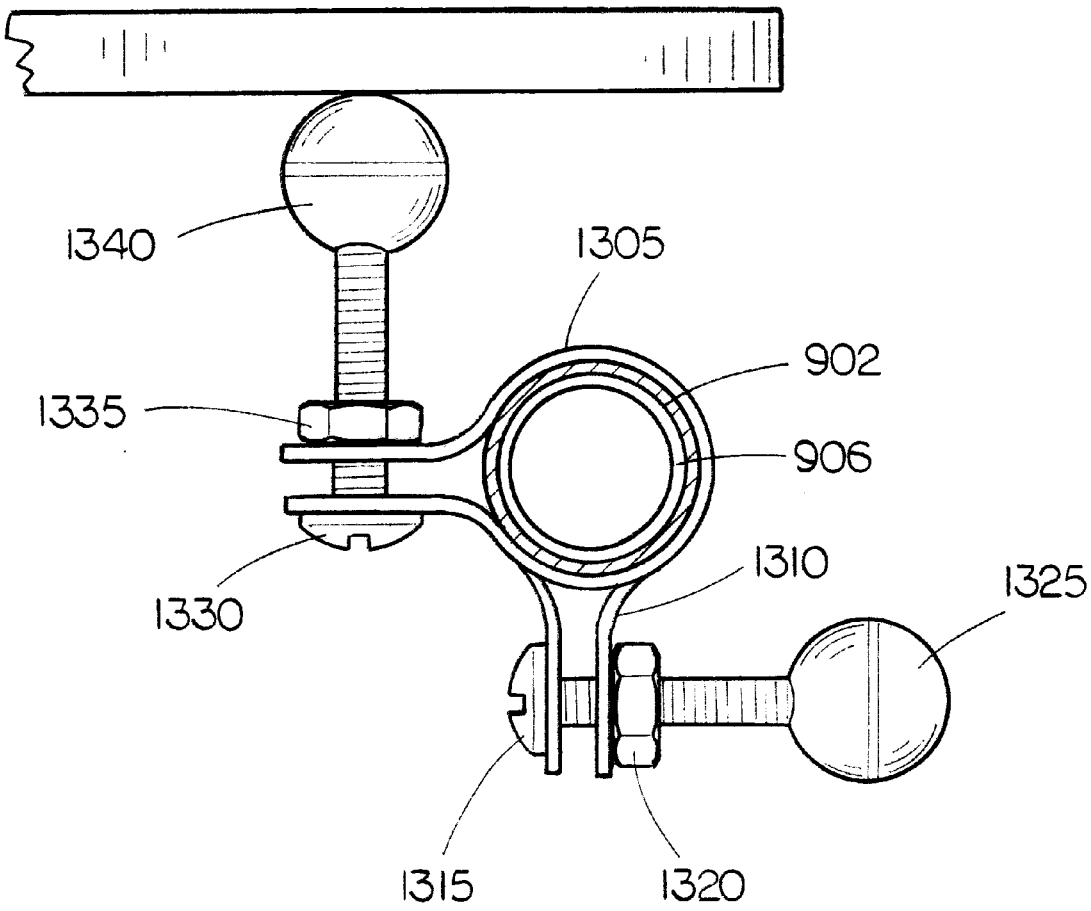
FIG. 13 is an illustration of a ball knob assembly coupled to the mounting tube and engaged with the tray of the tray assembly shown in FIG. 9.

The second, third, and fourth ball knob assemblies 903, 930, and 931 provide support to the tray 909 when in the utilization position as shown in FIGS. 9 and 10. The first, second, third, and fourth ball knob assemblies 903, 904, 930, and 931 are similar to the ball knob assembly 104 described in the previous FIGS. 1 through 8. An illustration of the first and the second ball knob assemblies 903 and 904 engaged with the first mounting tube 902 which encompasses the extension member 906, is shown in FIG. 13. Preferably, the second ball knob assembly 903 includes a clamp 1305 which engages mounting tube 902. A bolt 1330 is threaded through an end of the clamp 1305 and locks the position of the clamp 1305 in place by use of a nut 1335. In addition, a ball knob 1340 is connected to the bolt 1330. The ball knob 1340 engages the underside of the tray 909 providing support to the tray 909 when in the utilization position. The first ball knob assembly 904 includes a clamp 1310 which engages mounting tube 902. A bolt 1315 is threaded through an end of the clamp 1310 and locks the position of the clamp 1310 in place by use of a nut 1320. In addition, a ball knob 1325 is connected to the bolt 1330. The ball knob 1325 engages the multiple connection assembly 912 in a similar manner as that shown and described in FIG. 8. Thus, the ball knob 1325 engages with the multiple connection assembly 912 to store the tray 909 in the storage position.

Figure 11:
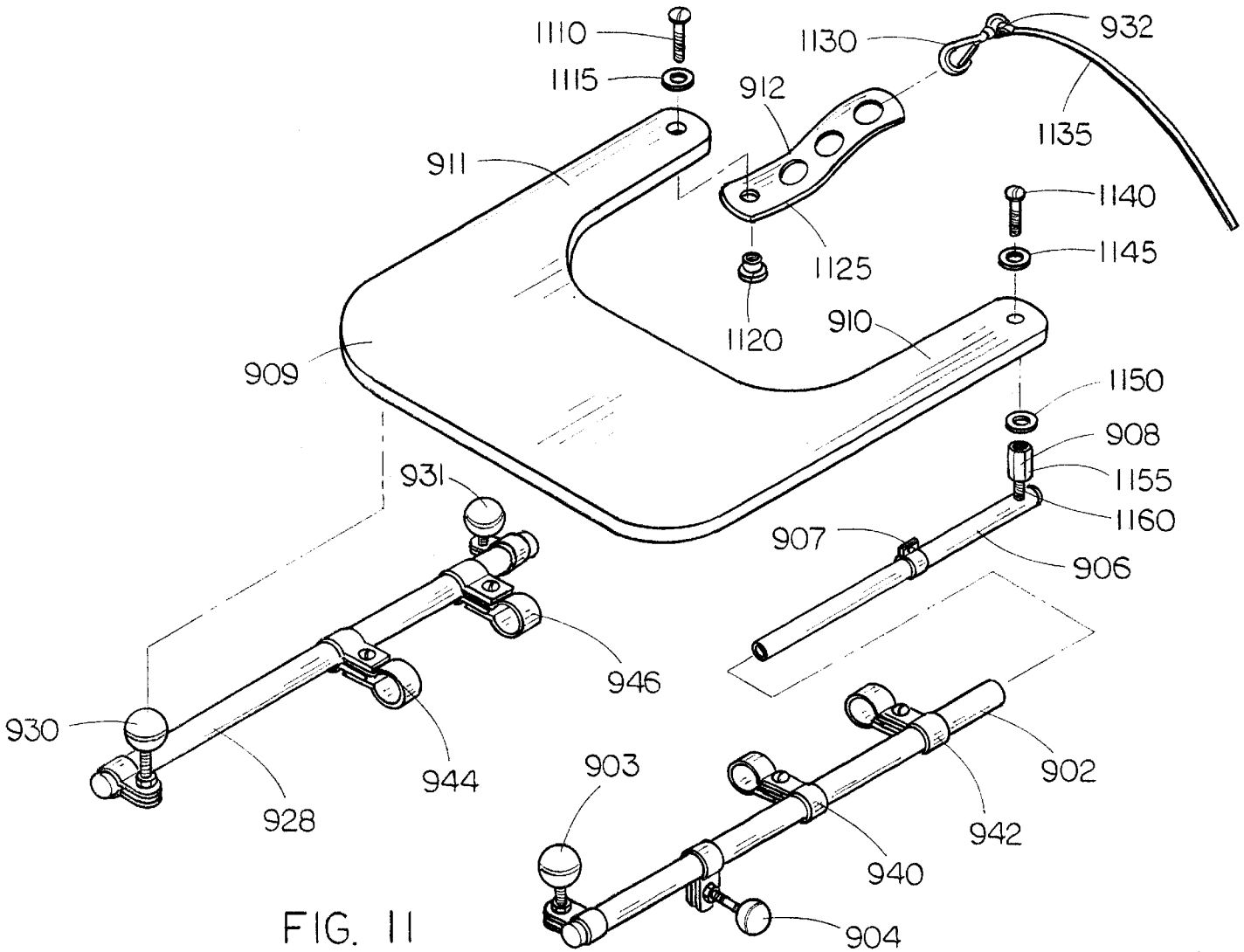
FIG. 11 is an exploded view of the tray assembly of FIG. 9.

An exploded view of the tray assembly including the swivel assembly 908, the multiple connection assembly 912, and the fastener assembly 932, is shown in FIG. 11. The swivel assembly 908 is similar to the swivel assembly shown and described in FIGS. 1 through 8. The swivel assembly 908 comprises a first bolt 1140 and a second bolt 1160. The first bolt 1 140 is inserted through the first arm 910 of the tray 909 and is cushioned with a first fender washer 1145 and a second fender washer 1150 and tightened to coupler 908. It is understood that the first and second bolts 1140 and 1160 may be a variety of fasteners, such as a socket head screw, or the like. The second bolt 1160 is captured through the wall of the extension member 906 by the insertion of a nut through and into the extension member 906. The second bolt 1160 is threaded through the nut until the nut tightly bottoms out against the inside wall of the extension member 906. The first bolt 1140 and the second bolt 1160 are threaded into the coupler 1155. The coupler 1155 allows the tray to rotate with the extension member 906 and swivel into its utilization or storage positions. It is further contemplated that the swivel assembly 908, through use of the coupler 1155, may be enabled to provide height adjustment capabilities to the tray assembly, allowing a user to adjust the height of the tray 909 relative to the position of the user in the seat 960.

In the current embodiment the multiple connection assembly 912 comprises an extendor 1125 which is connected to the second arm 911 of the tray 909 by a socket head screw 1110, a fender washer 1115, and a threaded T-nut 1120. In the current embodiment, the extendor 1125 is a flexible strap disposed with three coupling positions. It is contemplated that the number of coupling positions disposed on the extendor 1125 may vary. The extendor 1125 may be comprised of a variety of materials, such as leather, plastic, or the like. The three coupling positions may be established through use of a variety of mechanisms, such as holes cut in the material, snaps, buttons, buckles, or the like.

Referring now to the fastener assembly 932, shown in FIG. 11. Preferably, the fastener assembly 932 includes a snap 1130 affixed with a strap 1135. The snap 1130 may be a variety of devices, such as a buckle, compression lock, ball knob, or the like. The strap 1135 couples with the second rear vertical support member 926 of the chair assembly 900. A user may position the strap 1135 in a variety of locations to accommodate individual needs. It is understood that use of the strap 1135 to affix the snap 1130 to the chair assembly 900 is exemplary and that other methods and means of affixing the snap 1130 to the chair assembly 900 may be employed without departing from the scope and spirit of the present invention. For example, the strap 1135 may be a compression lock, magnetic attachment, buckle, or the like, and further the strap 1135 may provide an adjustable positioning means for the snap 1130.

Figure 12:
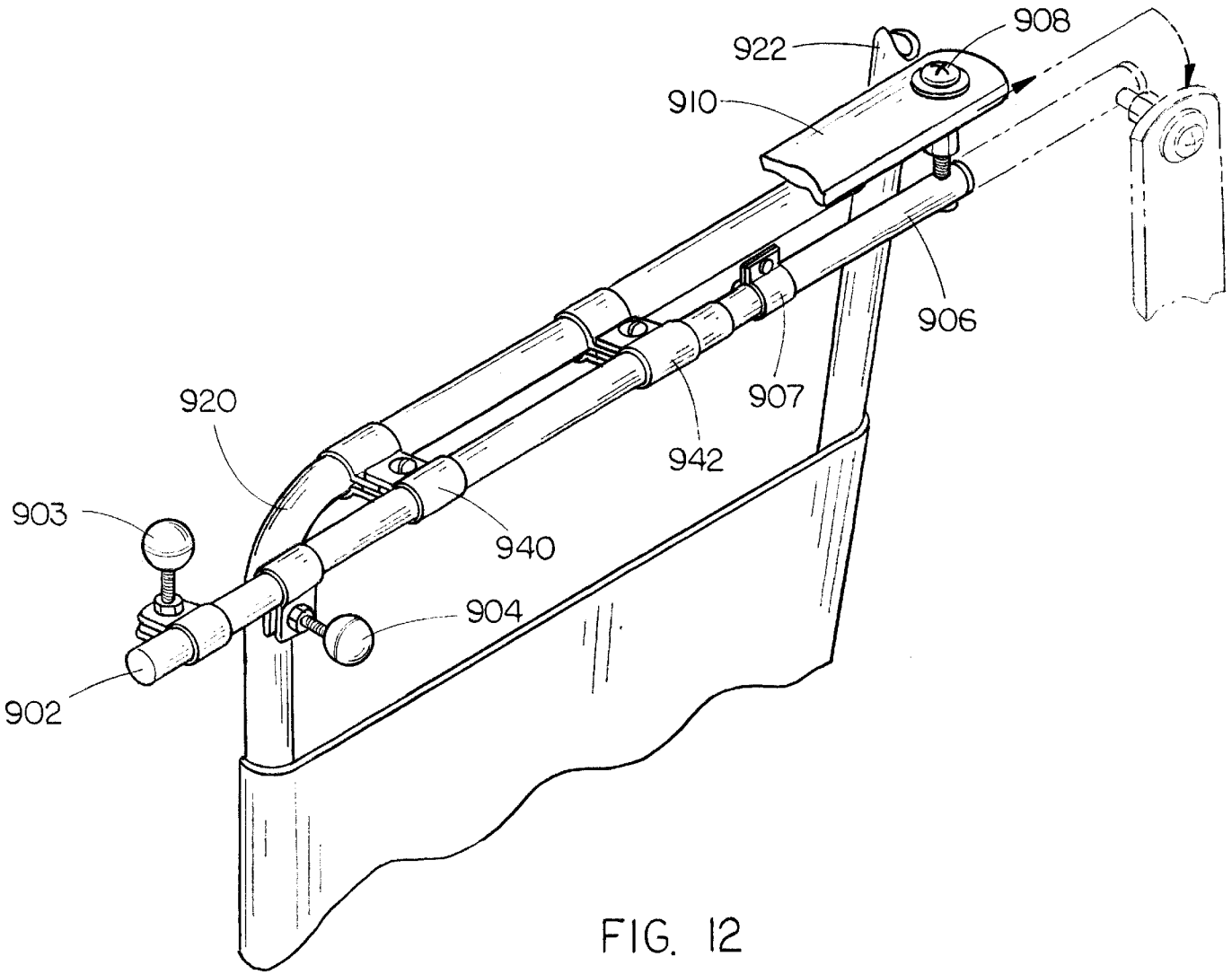
FIG. 12 is an illustration of a first arm of the tray coupled to an extension member, which is disposed within a mounting tube coupled to a wheelchair in accordance with an exemplary embodiment of the present invention shown in FIG. 9.

The mounting tube 902 is shown connected to the first support arm 920 by the first and second mounting assemblies 940 and 942, in FIG. 12. The mounting tube 902 extends beyond the first support arm 920 and connects the first and second ball knob assemblies 903 and 904. The telescopic and rotational movement capabilities of the extension member 906 within the mounting tube 902 are also illustrated. Further, the swivel assembly 908 is shown coupled with the first arm 910 of the tray 909. The rotational movement of the tray 909 when placed into the storage position is enabled by the swivel assembly 908 which allows the first arm 910 of the tray 909 to pivot freely. The stop assembly 907 limits the range of forward movement of the extension member 906, which limits the forward movement of the tray 909. The stop assembly 907 may be positioned by the user at any point between the swivel assembly 908 and the open end of the hollow mounting tube 902 within which the extension member 906 inserts. In this manner the user may further determine the size of the recess made available by the tray 909 when in the utilization position.

Similar to the features described above, in FIGS. 1 through 8, the multiple connection assembly 112 engages with the second ball knob assembly 904 when in the storage position. This engagement limits the motion of the extension member 906 within the mounting tube 902. Thus, the tray 909 is prevented from falling off the chair assembly 900 by preventing the extension member 906 from sliding out of the mounting tube 902. Further, the tray assembly connected to the chair assembly 900 is reversible. Thus, the tray assembly may be mounted on either side of the chair assembly 900 and function as shown and described above.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A tray assembly for use with a chair assembly, comprising:

a tray disposed with a first arm and a second arm, the second arm including a multiple connection assembly;

an extension member including a first end connected with a swivel assembly, the swivel assembly couples with the first arm of the tray;

a first mounting tube telescopically and rotatably coupled with the extension member, the mounting tube being connected to a first support arm of the chair assembly by a mounting assembly; and a ball knob assembly coupled with the first mounting tube, the ball knob assembly being suitable for coupling with the multiple connection assembly, wherein the multiple connection assembly of the tray couples with a fastener assembly, the fastener assembly being connected to a rear vertical member of the chair assembly, when the tray is in a utilization position and with the ball knob assembly when the tray is in a storage position, thereby, maintaining the ability to use the chair assembly.

2. The tray assembly of claim 1, wherein the ball knob assembly includes a height adjustment assembly for providing a user the ability to adjust the height of the tray when in the utilization position.

3. The tray assembly of claim 1, wherein the swivel assembly includes a height adjustment assembly for providing a user the ability to adjust the height of the tray when in the utilization position.

4. The tray assembly of claim 1, wherein the extension member is removably coupled to the mounting assembly.

5. The tray assembly of claim 1, wherein the extension member includes a stop assembly for limiting the range of movement of the extension member relative to the first mounting tube.

6. The tray assembly of claim 1, wherein the first mounting tube further includes a second ball knob assembly for providing support to the tray when in the utilization position.

7. The tray assembly of claim 1, wherein the chair assembly is at least one of a wheel chair and a stationary chair.

8. The tray assembly of claim 7, wherein the tray assembly further comprises a second mounting tube coupled to a second support arm of the at least one mobile chair and stationary chair, the second mounting tube including a third ball knob assembly for providing support to the tray when in the utilization position.

9. The tray assembly of claim 8, wherein the second mounting tube further includes a fourth ball knob assembly for providing support to the tray when in the utilization position.

10. An adjustable tray assembly for use with a chair assembly, comprising:

a tray disposed with a first arm and a second arm, the second arm including a multiple connection assembly;

an extension member including a first end connected with a height adjustable swivel assembly, the height adjustable swivel assembly couples with the first arm of the tray;

a first mounting tube telescopically, rotatably, and removably coupled with the extension member, the mounting tube being connected to a first support arm of the chair assembly by a mounting assembly; and a height adjustable ball knob assembly coupled with the first mounting tube, the height adjustable ball knob assembly being suitable for coupling with the multiple connection assembly, wherein the multiple connection assembly of the tray couples with a fastener assembly, the fastener assembly being connected to a rear vertical member of the chair assembly, when the tray is in a utilization position and with the ball knob assembly when the tray is in a storage position, thereby, maintaining the ability to use the chair assembly.

11. The adjustable tray assembly of claim 10, wherein the extension member includes a stop assembly for limiting the range of movement of the extension member relative to the first mounting tube.

12. The adjustable tray assembly of claim 10, wherein the first mounting tube further includes a second ball knob assembly for providing support to the tray when in the utilization position.

13. The adjustable tray assembly of claim 10, wherein the chair assembly is at least one of a wheel chair and a stationary chair.

14. The adjustable tray assembly of claim 13, wherein the adjustable tray assembly further comprises a second mounting tube coupled to a second support arm of the at least one mobile chair and stationary chair, the second mounting tube including a third ball knob assembly for providing support to the tray when in the utilization position.

15. The adjustable tray assembly of claim 14, wherein the second mounting tube further includes a fourth ball knob assembly for providing support to the tray when in the utilization position.

16. A wheelchair assembly including a pair of side frame members, each side frame member disposed with relatively vertical rear frame members connected with relatively horizontal support arms, lower cross supports, front castered wheels and large diameter drive wheels rotatably attached, for providing an adjustable tray assembly to a user, comprising:

a tray disposed with a first arm and a second arm, the second arm including a multiple connection assembly;

an extension member including a first end connected with a height adjustable swivel assembly, the height adjustable swivel assembly couples with the first arm of the tray;

a first mounting tube telescopically, rotatably, and removably coupled with the extension member, the mounting tube being connected to a first support arm of the wheelchair assembly by a mounting assembly; and a height adjustable ball knob assembly coupled with the first mounting tube, the height adjustable ball knob assembly being suitable for coupling with the multiple connection assembly, wherein the multiple connection assembly of the tray couples with a fastener assembly, the fastener assembly being connected to a rear vertical member of the wheelchair assembly, when the tray is in a utilization position and with the ball knob assembly when the tray is in a storage position, thereby, maintaining the ability to use the wheelchair assembly.

17. The wheelchair assembly of claim 16, wherein the first mounting tube further includes a second ball knob assembly for providing support to the tray when in the utilization position.

18. The wheelchair assembly of claim 16, wherein the extension member includes a stop assembly for limiting the range of movement of the extension member relative to the first mounting tube.

19. The wheelchair assembly of claim 18, wherein the wheelchair assembly further comprises a second mounting tube coupled to a second support arm of the wheelchair assembly, the second mounting tube including a third ball knob assembly for providing support to the tray when in the utilization position.

20. The wheelchair assembly of claim 19, wherein the second mounting tube further includes a fourth ball knob assembly for providing support to the tray when in the utilization position.

* * * * *